US005871409A

United States Patent [19]

Kimoto

[11] Patent Number: 5,871,409

[45] Date of Patent: Feb. 16, 1999

[54] VIBRATION ABSORBING DEVICE FOR THE STRINGS OR FRAME OF A RACKET

[75] Inventor: Kazumi Kimoto, Tokyo, Japan

[73] Assignee: Kimony's Incorporated, Tokyo, Japan

[21] Appl. No.: 988,666

[22] Filed: Dec. 11, 1997

[30] Foreign Application Priority Data

Jan. 31, 1997 [JP] Japan ..... 9-018997

[51] Int. Cl.[6] ..... A63B 49/00

[52] U.S. Cl. ..... 473/522

[58] Field of Search ..... 473/522, 521, 473/520, 553, 178

[56] References Cited

U.S. PATENT DOCUMENTS

| | | | |
|---|---|---|---|
| 4,589,662 | 5/1986 | Robaldo | 473/522 |
| 4,761,007 | 8/1988 | Boschian | 473/522 |
| 4,765,620 | 8/1988 | Janes | 473/521 |
| 4,909,509 | 3/1990 | Boschian | 473/522 |
| 4,927,143 | 5/1990 | Hillock | 473/522 |
| 5,022,651 | 6/1991 | Barone | 473/522 |
| 5,106,086 | 4/1992 | Acosta | 473/522 |

FOREIGN PATENT DOCUMENTS

| | | | |
|---|---|---|---|
| 2681254 | 3/1993 | France | 473/178 |

*Primary Examiner*—Raleigh Chiu
*Attorney, Agent, or Firm*—David O'Reilly

[57] ABSTRACT

A vibration proof device for strings or frame of a racket for sports in which it is possible to absorb vibration not only of the strings but also the frame without hindering operation, comprised of a block of rubber or plastic having a centrally located mushroom shaped vibrator integrally formed by punching or moulding, said block having a size that is substantially the same size as the width between strings and having longitudinal recesses in opposite sides for fitting between strings in use.

7 Claims, 3 Drawing Sheets

VIBRATION ABSORBING DEVICE FOR THE STRINGS OR FRAME OF A RACKET

BACKGROUND OF THE INVENTION

1. Field of the Invention

The present invention relates to a vibration proof device for strings or frame of a racket for sports.

2. Background Information

Heretofore, as shown in FIG. 3, block 10 of rubber or plastic combined with a high grade special silicon vibration proof rubber having a vibration absorber 11 at the middle, being the same size that corresponds to the width between strings has longitudinal recesses 13, 13 on opposite sides for fitting between and engaging strings 12, 12 (gut) as shown on FIG. 4. Otherwise, a mushroom shaped vibration absorber 14 is attached to the end face of handle. However, the vibration absorbing effect is not sufficient in block 10 shown in FIG. 3, or with vibration absorber 14 shown in FIG. 4 because it hinders operation of the racket.

BRIEF DESCRIPTION OF THE INVENTION

This invention intends to eliminate said drawback. One object of this invention is to provide a vibration proofing device for the strings or frame of a racket for sports in which mushroom shaped vibration absorber 2 can displace not only right or left against strings 12, 12 but in all directions around 360 degrees including the vertical direction against the face of strings 12, 12 so that it is possible to absorb the vibration not only of strings 12, 12 but the frame of the racket.

The above and other objects, advantages and novel features of this invention will be more fully understood from the following detailed description and the accompanying drawings, in which like reference numbers indicate like or similar parts throughout wherein:

DETAILED DESCRIPTION OF THE INVENTION

Figure 1A:
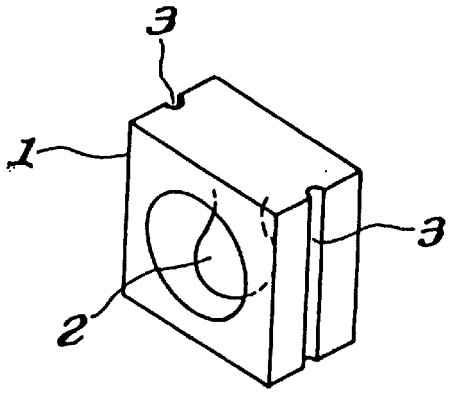
FIG. 1A is a perspective view of one embodiment of the invention.
Figure 1B:
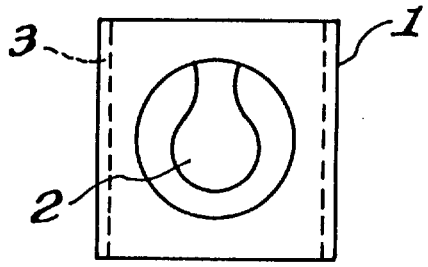
FIG. 1B is a front view of the embodiment of FIG. 1A.
Figure 1C:
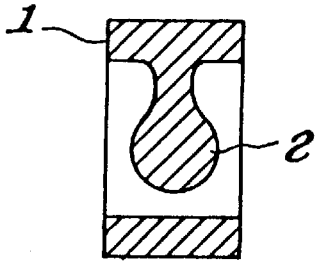
FIG. 1C is a longitudinal cross section of the embodiment of FIG. 1.

As shown in FIG. 1A, paragraph 1C, in one embodiment of this invention, block 1 of rubber or plastic has a centrally located vibration absorber 2 of a mushroom shape integrally formed by punching or moulding. Block 1 is substantially the same size or width as the space between strings and has longitudinal recesses 3, 3 in opposite sides that fit between and engage strings 12, 12. The width of block 1 is preferably 12 to 14 mm, length is 15 mm, with a thickness of about 7 to 9 mm. It is possible to construct vibration absorber 2 by special heavy material and connect it at the center of block 1. In this case, space to allow for vibration of vibration absorber 2 is necessary.

Figure 4:
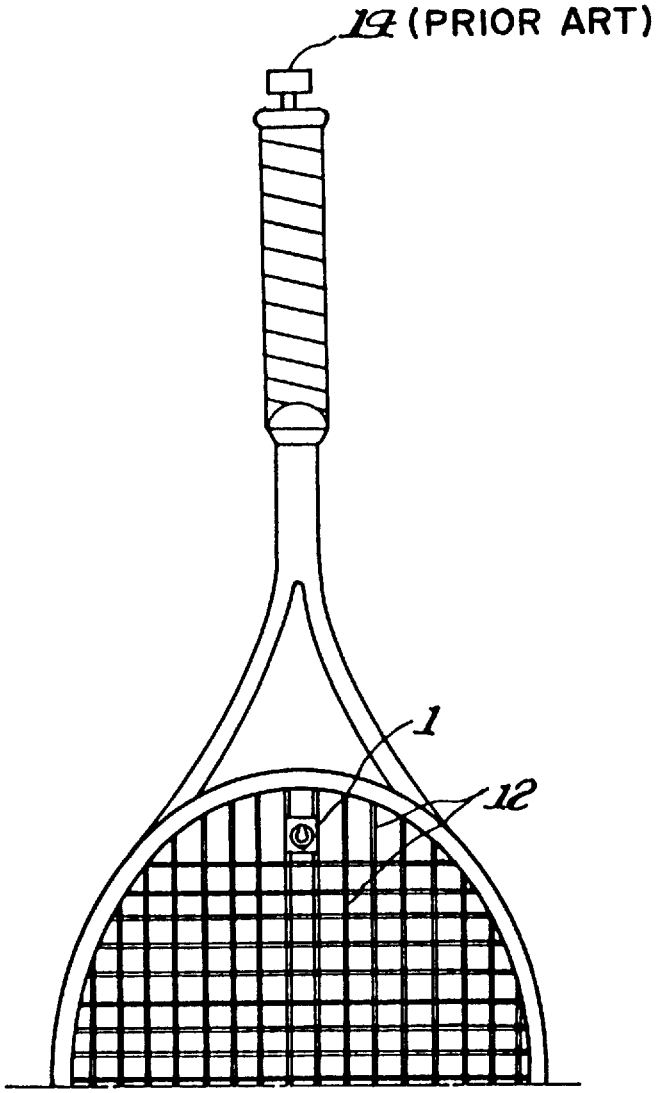
FIG. 4 is an explanatory view also showing another prior art device.

In use, as shown in FIG. 4 longitudinal recesses 3, 3 fit between and engage strings 12, 12. Mushroom shaped vibration absorber 2 displaces not only in the right or left direction toward strings 12, 12 but in all direction around 360 degrees including a vertical direction against the face of strings 12, 12 so that it is possible to absorb the vibration not only of strings 12, 12 but also the frame of the racket.

Figure 2:
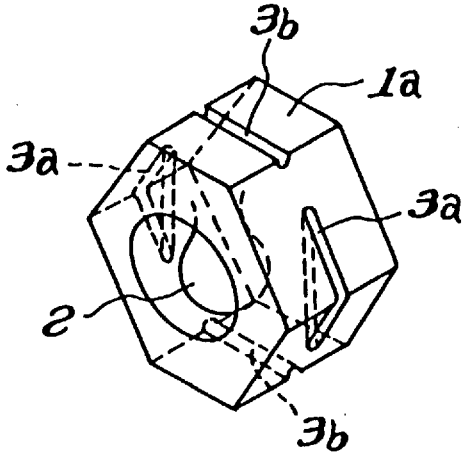
FIG. 2 is a perspective view of an alternate embodiment of this invention.
Figure 3:
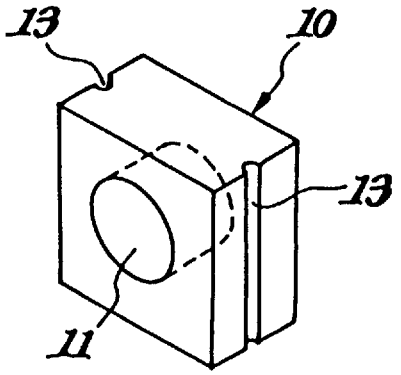
FIG. 3 (PRIOR ART)
FIG. 3 is a side view of a prior art device.

FIG. 2 is a perspective view of an other embodiment of the invention, in which the same parts have the same reference numbers. Block 1A has a hexagon shape from a front view and longitudinal recesses 3, 3 extending in a triangular shaped part along opposite sides, so that recesses have a depth sufficiently deep so there is no fear they may become dislodged from strings 12.

Recesses 3*b* may be also provided at upper and lower faces for fitting strings in transverse direction providing four in all.

What is claimed is:

1. A vibration damping device for attachment to the strings of a racket comprising; a block of resilient material; a centrally located bore through said resilient block; a mushroomed shaped lobe in said centrally located bore; longitudinal recesses in opposite sides of said resilient block for fitting the strings of said racket; whereby said resilient block can be inserted between strings of a racket and dampen vibrations.

2. The device according to claim 1 in which said mushroom shaped lobe is integrally formed in said block.

3. The device according to claim 2 in which said block is a rectangular shaped block.

4. The device according to claim 1 in which said block is a hexagonal shaped block.

5. The device according to claim 4 in which said longitudinal shaped recesses are triangular shaped.

6. The device according to claim 5 including a second pair of recesses in the top and bottom of said hexigonal shaped block respectively.

7. A vibration proof device for strings or frame of a racket for use in sports comprising; a block of rubber or plastic (1) having a centrally located mushroom-shaped vibration absorber (2) integrally formed in said block by punching or moulding; said block being substantially the same size as the width between said strings (12); and including longitudinal recesses (3) in opposite sides for engaging and fitting between strings (12) of said racket in use.

* * * * *